US006895886B1

(12) United States Patent
Pawlowski et al.

(10) Patent No.: US 6,895,886 B1
(45) Date of Patent: May 24, 2005

(54) BOAT HOIST CANOPY SKIRT

(76) Inventors: Richard F. Pawlowski, 4836 Lean To Point, Panora, IA (US) 50216; Todd R. Pawlowski, P.O. Box 71681, Clive, IA (US) 50325

( * ) Notice: Subject to any disclaimer, the term of this patent is extended or adjusted under 35 U.S.C. 154(b) by 0 days.

(21) Appl. No.: 10/620,952

(22) Filed: Jul. 16, 2003

Related U.S. Application Data

(60) Provisional application No. 60/396,382, filed on Jul. 17, 2002.

(51) Int. Cl.[7] ..... B63B 17/02
(52) U.S. Cl. ..... 114/361; 135/90; 296/26.05
(58) Field of Search ..... 114/361; 135/90, 135/87, 122; 296/26.05; 428/192; 156/247

(56) References Cited

U.S. PATENT DOCUMENTS 4,019,212 A 4/1977 Downer
4,363,284 A 12/1982 Monroe
4,683,901 A * 8/1987 Mitchell ..... 135/97
5,224,569 A 7/1993 Hewitt et al.
5,564,358 A 10/1996 Newton
5,573,026 A 11/1996 Griffith
5,709,501 A 1/1998 Elbers
6,102,059 A 8/2000 Miller
6,170,503 B1 1/2001 Lin Shy

* cited by examiner

*Primary Examiner*—Jesus D. Sotelo
(74) *Attorney, Agent, or Firm*—McKee, Voorhees & Sease, P.L.C.

(57) ABSTRACT

A skirt for a boat hoist is provided to enclose a boat on the hoist. The skirt includes a plurality of panels adapted to be hung from the canopy frame of the hoist. One of the panels is a door panel which can be raised and lowered to provide access to the boat. Another panel is a rear panel extending across the rear end of the hoist and being moveable between raised and lowered positions to allow entry and exit of the boat to and from hoist. The door and rear panels are moveable independently of the side and front panels. The panels are weighted and may have wind vents to prevent blowing the panels in the wind.

24 Claims, 5 Drawing Sheets

BOAT HOIST CANOPY SKIRT

CROSS-REFERENCE TO RELATED APPLICATIONS

This is a conversion of provisional application U.S. Ser. No. 60/396,382 filed Jul. 17, 2002.

BACKGROUND OF THE INVENTION

This invention relates to a boat hoist canopy skirt to surround a boat, such as a ski boat, fishing boat, pontoon boat, and personal water craft and protect the boat from the environment. The sun can cause the value of a boat to decline by fading the finish of the boat, upholstery, and the carpet. The sun also deteriorates the seat fabric and stitching. To help minimize these effects of the environment, boat hoists often include large canopies which shade the boat from the sun, rain and other aspects of the environment. However, a large canopy does not fully protect a boat from all elements of the environment. Depending on the time of day, the sun still hits portions of the boat. Also, dirt, rain, leaves and other elements in the environment are still able to blow into the boat. Birds also build nests under the canopy. A canopy also provides no privacy or deterrent to theft of items in the boat by passerbys who can see into the boat.

Prior art boat covers are known that are supported by the boat hoist or lift. However, such prior art covers typically must be completely removed or raised to allow access to the boat and to allow the boat to enter and exit the hoist or lift. Also, some prior art boat covers do not cover or protect the sides of the boat, but rather leave the sides exposed.

Thus, it is a primary objective of the present invention to provide a boat hoist canopy skirt for surrounding a boat on a hoist.

Another objective of the present invention is the provision of a boat hoist canopy skirt that can easily be attached to the boat hoist.

Yet another objective of the present invention is the provision of a boat hoist canopy skirt or protective system that allows easy access into the boat.

A further objective of the present invention is the provision of a boat hoist canopy skirt that has a venting system to reduce wind pressure.

A further objective of the present invention is the provision of a boat hoist canopy skirt allowing entry and exit of the boat to and from the hoist.

These and other objectives, features, or advantages of the present invention will become apparent from this application.

SUMMARY OF THE INVENTION

The boat hoist canopy skirt of the present invention includes a plurality of panels adapted to hang from the canopy frame so as to form an enclosure extending around a boat on the hoist. More particularly, the skirt includes a front panel, a rear panel, opposite side panels, and one or more door panels. The rear panel is moveable between raised and lowered positions to allow entry and exit of a boat to and from a hoist. The door panel is also moveable between raised and lowered positions to allow people to enter and exit the boat while the boat is on the hoist. Each panel includes a lower pocket in which a pipe or other elongated member is placed to provide weight and structure to minimize waving of the panels in the wind. Each panel may also have wind vents to minimize the force of wind on the panels. The skirt protects the boat from sun damage, keeps rain, dirt, and leaves out of the boat, and deters theft of items in the boat by precluding people from seeing into the boat.

DETAILED DESCRIPTION OF THE INVENTION

Figure 1:
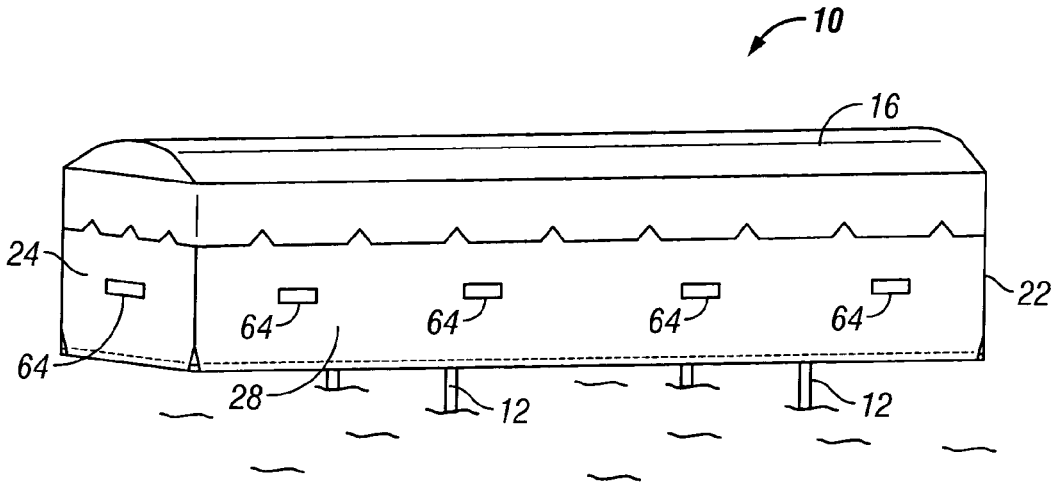
FIG. 1 is a front corner perspective view of the boat hoist canopy skirt of the present invention.

A boat hoist or lift having the skirt of the present invention is generally designated in the drawings by the reference numeral 10. The hoist 10 is conventional in construction, and generally includes four legs 12, a canopy frame 14 mounted on top of the legs, a canopy 16 secured to the canopy frame 14, and a lift mechanism (not shown) for supporting a boat 18. In one type of hoist, a crank wheel 20 controls raising and lowering of the lift mechanism. Alternative hoist or lift structures utilize hydraulics to raise and lower the boat, without a crank wheel.

Figure 2:
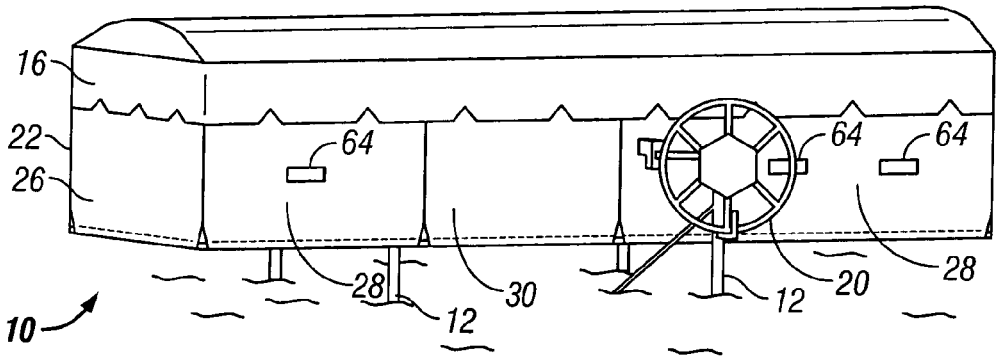
FIG. 2 is a rear corner perspective view of the hoist skirt.
Figure 3:
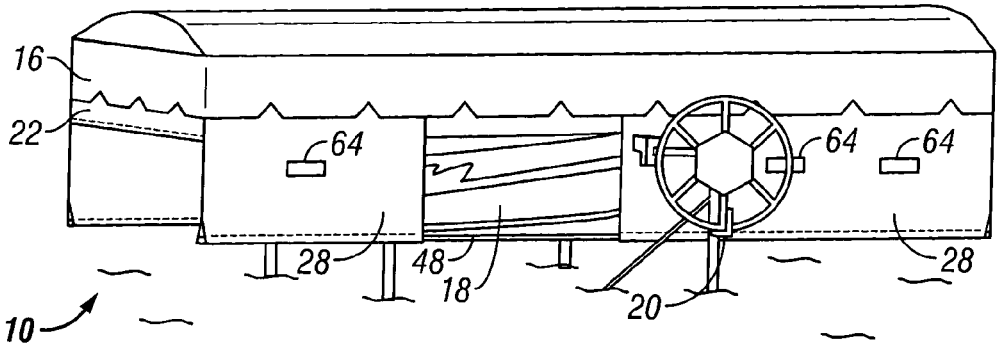
FIG. 3 is a view similar to FIG. 2 showing the rear panel and door panel moved to their raised positions.
Figure 4:
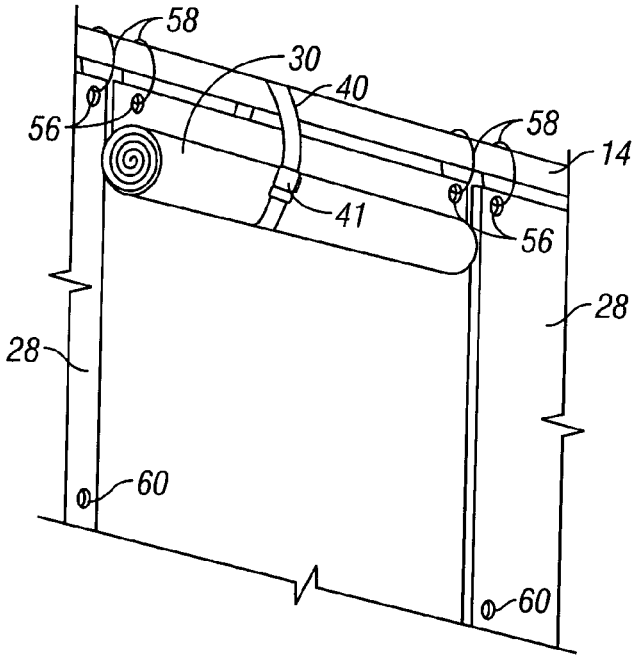
FIG. 4 is a perspective view showing the door panel rolled up into its raised position.

The present invention is directed towards a skirt 22 which is secured to the canopy frame 14 so as to enclose the boat 18, as seen in FIGS. 1 and 2. It is understood that boat means any type of watercraft which may be placed on a hoist or lift. The skirt includes a front panel 24, a rear panel 26, opposite side panels 28, and a door panel 30. The front panel 24 and side panels 28 are intended to remain in a lowered position. The rear panel 26 and door panel 30 are moveable between raised positions, as shown in FIG. 3, and lowered positions, as shown in FIGS. 1 and 2.

Preferably, the rear panel 26 is raised and lowered with a pulley system, including one or more pulleys 32 mounted on the canopy frame 14 inside the hoist 10. Ropes 34 have one end 36 secured to the rear panel 26, and then extend over the pulleys 32 with the opposite end 38 adapted to be pulled by a person to raise the rear panel 26. The loose end or ends 38 of the ropes 34 may be tied to the rope cleat 37 or to any convenient part of the hoist 10 or canopy frame 14 to maintain the rear panel 26 in the raised position. The door panel 30 preferably is rolled up beneath the canopy 16 and held by a strap 40 and a buckle 41.

Figure 7:
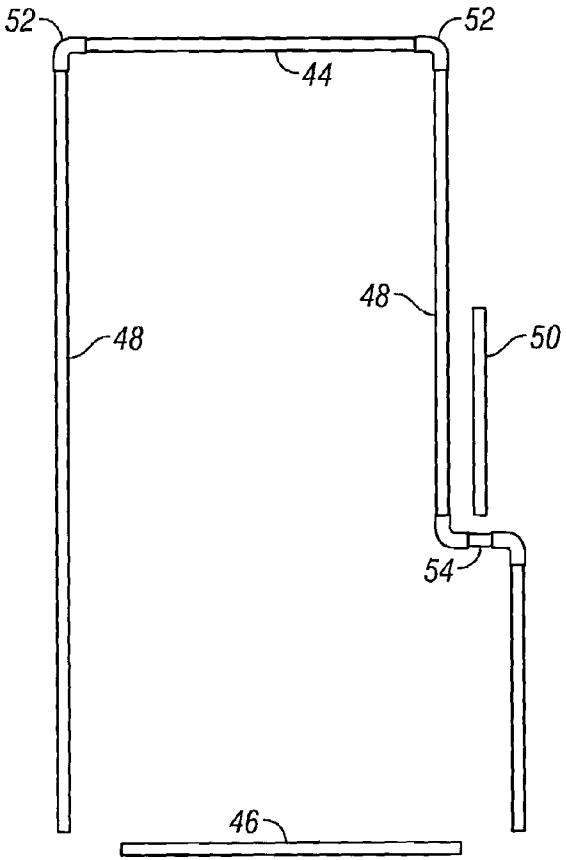
FIG. 7 is a schematic plan view showing the arrangement of pipe weights which extend through pockets in the lower edges of the skirt panels, or are otherwise secured to the skirt panels.
Figure 9:
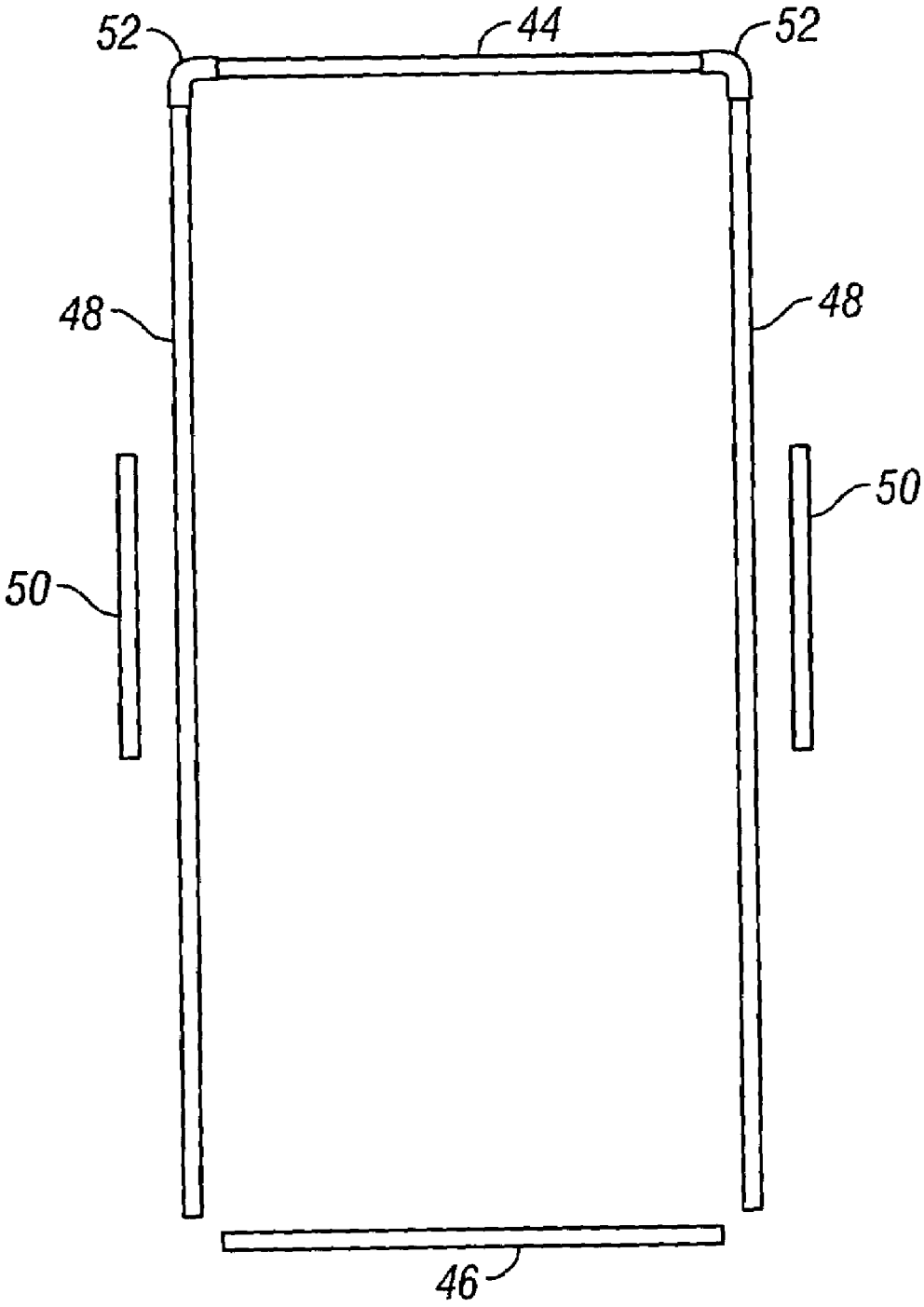
FIG. 9 is a schematic plan view of an alternative embodiment of the pipe weights and wherein a door is provided on each side.

Each of the panels 24, 26, 28 and 30 are preferably formed with a pocket 42 at their lower edges. Each pocket 42 is adapted to receive a pipe, such as a PVC pipe, or other elongated member to add weight and provide structure to the panels so as to minimize blowing of the panels 24–30 in the wind. More particularly, the front panel 24 receives a front pipe 44, the rear panel 26 receives a rear pipe 46, the side panels 28 receive side pipes 48, and the door panel 30 receives a door pipe 50. The side pipes 48 do not extend through the door panel 30, so that the door 30 is free to be raised and lowered. Preferably, the side pipes 48 are connected to the opposite ends of the front pipe 44 with elbows 52. Thus, the front pipe 44 and side pipes 48 form a substantially U-shape member which extends continuously around the hoist 10, except for the rear end thereof. As seen in FIG. 7, one of the side pipes 48 may include a short laterally extending leg 54 to extend around the hoist leg 12 adjacent the rear end of the door panel 30. Alternatively, as seen in FIG. 9, the pipes 48 may extend straight, without any lateral extensions. It is also understood that the pipes 48 may reside either inside or outside the hoist legs 12, and may be configured in various ways. It is understood that other separate weights may be provided for each panel 24–30.

Figure 5:
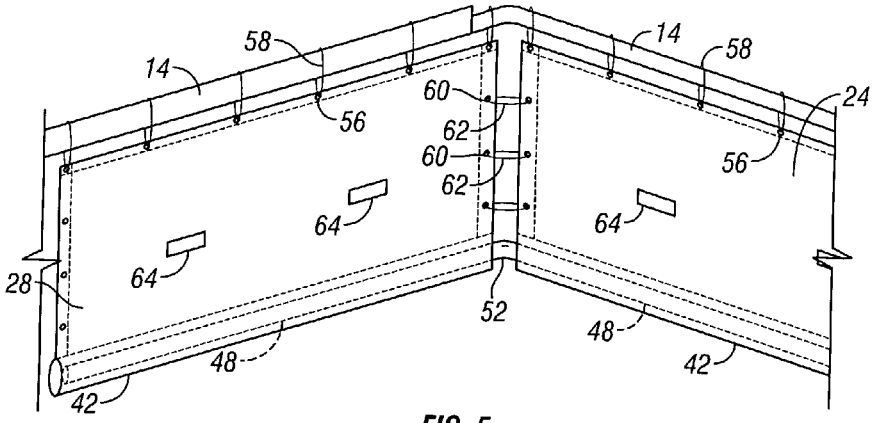
FIG. 5 is a partial perspective view from inside the hoist showing a front corner of the skirt.

The panels 24–30 each include an upper edge with grommets 56 through which straps 58 extend for securing the panels to the canopy frame 14. As an alternative to grommets 56, rings, webbing loops or similar attachments may be provided. Buckles may be provided on the straps 58 for quick assembly adjustment and disassembly of the panels 24–30 on the canopy frame 14. Other securement means can also be utilized, such as split rings, snaps, zippers, velcro, ropes, bungee cords, cable ties, etc. As seen in FIG. 5, the opposite ends of the front panel 24 and the adjacent ends of the side panels 28 may also include grommets 60 on the ends thereof to receive tie members 62 so as to secure the front panel 24 to the side panels 28.

Figure 6:
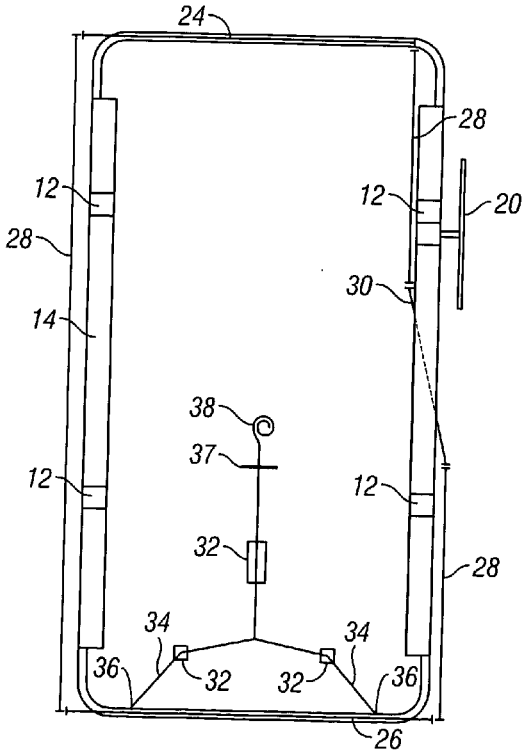
FIG. 6 is a schematic plan view showing the location of the skirt panels relative to the hoist.
Figure 8:
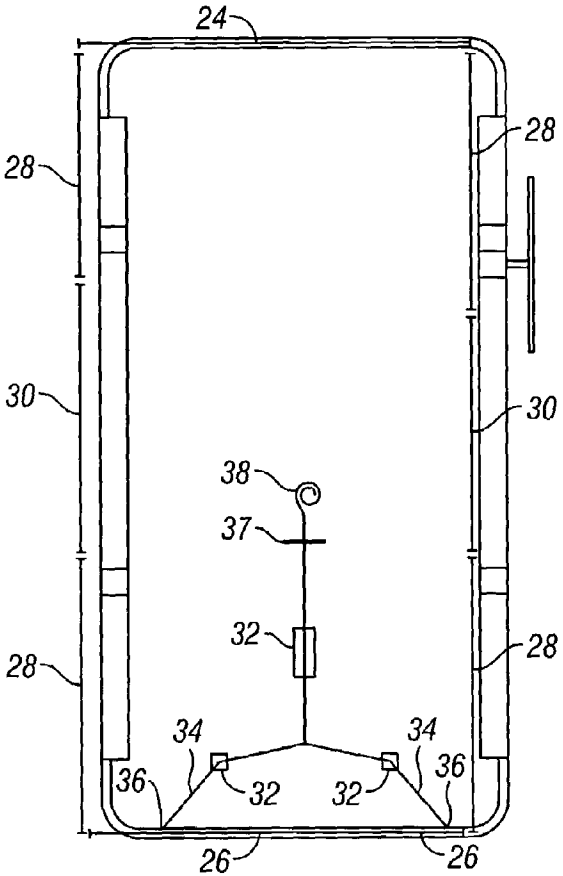
FIG. 8 is a schematic plan view of an alternative embodiment of the invention using eight skirt panels and with a door provided on each side.

As seen in FIG. 6, the skirt 22 is preferably made with six panel sections as described previously. As an alternative, eight panels may be used, as shown in FIG. 8, including a front panel 24, a rear panel 26, side panels 28, and opposite door panels 30 on each side of the hoist 10.

Each panel 24–30 may also include one or more wind vents 64 to allow wind to pass therethrough and thereby minimize the force of wind on the lowered panels. When all the panels 24–30 are lowered, the skirt completely surrounds the boat 18 with the canopy 16 covering the boat, thereby protecting the boat from the elements. The panels 24–30 are made from any suitable material, such as a vinyl-coated nylon, a vinyl-coated woven polyester, a laminate, canvas, or a coated mesh product.

Therefore, it can be seen that the present invention accomplishes at least all of the stated objectives. The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A skirt for a boat hoist having a front end, a rear end, opposite sides, and a canopy frame, the skirt comprising:

a plurality of panels adapted to hang from the canopy frame so to form an enclosure extending around a boat on the hoist;

one of the panels being a side door panel moveable between a closed position and an open position to provide access to a side of the boat; and one of the panels being a rear panel extending substantially across the rear of the hoist and being moveable between a closed position and an open position to allow entry and exit of the boat to and from the hoist.

2. The skirt of claim 1 wherein the door panel is raisable to an open position and lowered to a closed position.

3. The skirt of claim 1 further comprising a pulley system mounted in the canopy frame and having at least one rope connected to the rear panel for raising the rear panel to the open position.

4. The skirt of claim 1 wherein at least one panel includes wind vents.

5. The skirt of claim 1 wherein each panel has a lower edge which is weighted.

6. The skirt of claim 1 wherein each panel includes a lower edge with a pocket therein, and an elongated member residing within the pocket.

7. The skirt of claim 6 wherein the elongated members include a front member and opposite side members joined to opposite ends of the front member.

8. The skirt of claim 1 further comprising a U-shaped lower weight extending across the front and sides of the hoist and being secured to a lower edge of the panels.

9. The skirt of claim 1 wherein each panel has an upper edge with grommets adapted to receive a tie member for securing the panel to the canopy frame.

10. The skirt of claim 1 wherein each panel has opposite sides with grommets adapted to receive tie members for securing adjacent edges together.

11. The skirt of claim 1 further comprising a second door panel to provide additional access to the boat.

12. The boat hoist skirt of claim 1 wherein the door panel is moveable independently of the other panels.

13. A boat hoist skirt for enclosing a boat on the hoist, comprising:

a front panel;

a rear panel;

opposite side panels;

a door in one of the side panels moveable between raised and lowered positions; and the rear panel being moveable between raised and lowered positions independently of the side panels.

14. The boat hoist skirt of claim 13 wherein each panel is weighted.

15. The boat hoist skirt of claim 13 wherein each panel includes a lower edge with a pocket and a weight in the pocket.

16. The boat hoist skirt of claim 13 wherein at least one panel has at least one wind vent.

17. The boat hoist skirt of claim 13 wherein each panel includes an upper edge adapted to be secured to the hoist.

18. The boat hoist skirt of claim 13 further comprising a pulley system to raise and lower the rear panel.

19. The boat hoist skirt of claim 13 further comprising a U-shaped member secured to the front and side panels adjacent lower edges thereof.

20. The boat hoist skirt of claim 13 wherein each panel has an upper edge with grommets for tying the panels to the hoist.

21. The boat hoist skirt of claim 13 wherein the side panels are each secured to the front panel.

22. The boat hoist skirt of claim 13 further comprising a door panel movable between raised and lowered positions to provide access to the boat.

23. The boat hoist skirt of claim 13 further comprising a second door panel movable between raised and lowered positions.

24. The boat hoist skirt of claim 13 wherein the door is moveable independently of the panels.

* * * * *